US006550631B2

(12) United States Patent
Thompson

(10) Patent No.: US 6,550,631 B2
(45) **Date of Patent: *Apr. 22, 2003**

(54) DRINKING FLASK

(75) Inventor: Christopher Mark Francis Thompson, Tonbridge (GB)

(73) Assignee: Vogue International Limited, England (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 24 days.

(21) Appl. No.: 09/424,829

(22) PCT Filed: May 20, 1998

(86) PCT No.: PCT/GB98/01456

§ 371 (c)(1),
(2), (4) Date: Nov. 29, 1999

(87) PCT Pub. No.: WO99/03382

PCT Pub. Date: Jan. 28, 1999

(65) Prior Publication Data

US 2002/0053574 A1 May 9, 2002

(30) Foreign Application Priority Data

Jul. 18, 1997 (GB) ..... 9715015

(51) Int. Cl.[7] ..... B05D 51/18; A63H 3/52

(52) U.S. Cl. ..... 220/709; 220/710; 446/267

(58) Field of Search ..... 220/574, 592.17, 220/62.12, 703, 704, 705, 706, 707, 708, 709, 719, 710, DIG. 7, 378; 222/74, 464.1; D7/300.2, 900; 426/85, 115; 229/400, 404; 215/388, 389; 446/267, 177, 176, 202

(56) References Cited

U.S. PATENT DOCUMENTS

| | | | | |
|---|---|---|---|---|
| 1,441,623 A | | 1/1923 | Davenport | |
| 2,914,214 A | | 11/1959 | Messinger | |
| 3,729,136 A | * | 4/1973 | Friedman | D7/300.2 |
| 4,007,936 A | * | 2/1977 | Hornsby, Jr. | 215/228 |
| 4,133,446 A | | 1/1979 | Albert | |
| 4,189,072 A | * | 2/1980 | Conn | 220/705 |
| 4,462,544 A | * | 7/1984 | Rutzel et al. | 215/388 |
| 4,576,336 A | * | 3/1986 | Cohen et al. | 215/389 |
| 4,596,341 A | | 6/1986 | Bruffey | |
| 4,709,829 A | | 12/1987 | Johnson et al. | |
| 4,884,717 A | * | 12/1989 | Bussard et al. | 220/229 |
| 4,966,300 A | * | 10/1990 | Coonradt | 220/707 X |
| 4,990,119 A | * | 2/1991 | Amici et al. | 440/267 |
| D332,547 S | * | 1/1993 | Lipson | D7/300.2 |
| 5,203,468 A | | 4/1993 | Hsu | |
| 5,249,702 A | * | 10/1993 | Topp et al. | 220/705 |

(List continued on next page.)

FOREIGN PATENT DOCUMENTS

| | | |
|---|---|---|
| DE | 9320098 | 3/1994 |
| DE | 29517969 | 3/1996 |
| DE | 29608257 | 10/1996 |
| GB | 2056419 | 3/1981 |
| RU | 2020845 | 10/1994 |
| WO | 9401026 | 1/1994 |

*Primary Examiner*—Joseph M. Moy
(74) *Attorney, Agent, or Firm*—Edwin D. Schindler

(57) ABSTRACT

A drinking vessel comprises a body part (10) to receive a drinks liquid, a lid (30) to seal the top of the body part, a liquid outlet passage (50, 52) extending down to a lower region of the interior space of the body part, and an air intake passage (54) also extending down to the lower region of the interior space of the body part. As the user draws liquid out of the vessel through the liquid outlet passage (50, 52), replacement air enters through the air intake passage (54) and then bubbles upwardly through the liquid within the vessel.

16 Claims, 2 Drawing Sheets

U.S. PATENT DOCUMENTS 5,273,172 A * 12/1993 Rossbach et al. ..... 220/705 X
5,337,918 A 8/1994 Wang
5,495,870 A 3/1996 Dorta
5,651,471 A * 7/1997 Green ..... 220/705
5,755,354 A * 5/1998 Lang ..... 220/703 X
5,816,884 A * 10/1998 Chang ..... 446/267
5,918,761 A * 7/1999 Wissinger ..... 220/378
6,095,886 A * 8/2000 Beckman et al. ..... 446/267

* cited by examiner

DRINKING FLASK

The present invention relates to a flask or other drinking vessel and more particularly to a drinking vessel which is sealed and from which the user draws the liquid via a suction tube.

Flasks or other drinking vessels which are sealed, and from which the user draws the liquid via a suction tube, are particularly useful for young children because the risk of spillage is reduced. Various flasks have been proposed hitherto which allow the user to draw liquid out of the sealed flask whilst allowing air into the flask to replace the liquid which is consumed. These flasks have either failed to prevent spillage of liquid out of the air-inlet orifice, or have been of complicated and therefore expensive construction.

We have now devised a drinking vessel which is of relatively simple and inexpensive construction but which is effective sealed. Moreover, the vessel is arranged to provide a visual feature which is attractive to the user.

In accordance with the present invention, there is provided a drinking vessel which comprises a body part providing a vessel to receive a drinks liquid, a lid arranged to close the top of the body part in sealed manner, a liquid outlet passage extending downwardly to a lower region of the interior space of the body part, and an air intake passage also extending downwardly to the lower region of the interior space of the body part.

In use, as the user draws liquid out of the vessel through the liquid outlet passage, replacement air enters through the air intake passage and then bubbles upwardly through the liquid within the vessel. Preferably at least part of the side wall of the body part of the vessel is transparent, so that the user can observe the replacement air bubbling upwardly through the liquid. The user will also feel a vibratory effect as the air bubbles through the liquid, also adding to the attraction of the vessel. In some cases, the bubbling of air through the liquid may enhance the liquid itself (e.g. where the liquid is carbonated).

Preferably at least part of the lid is transparent. Preferably the lid comprises a main part having a peripheral sealing member of elastomeric material. Instead the sealing member may be provided on the rim of the body part of the vessel: alternatively, the lid may be arranged to push-fit into and seal directly with the inner surface of the body part of the vessel.

Preferably the liquid outlet passage extends to the bottom, or substantially to the bottom, of the interior space of the vessel. The air intake passage preferably extends at least half-way to the bottom of the interior space of the vessel: most preferably the air intake passage extends to the bottom, or substantially to the bottom, of the interior space of the vessel.

The liquid outlet and air intake passages may comprise tubes which are connected to the lid and extend downwardly within the interior space of the body part of the drinking vessel. The liquid outlet and air intake tubes may be engaged with the lid at generally diametrically opposite positions of the latter. In this case the air intake tube is coupled to a duct extending through the lid, of relatively small size compared with the diameter or cross-section of the air intake tube itself.

The upperside of the lid may be formed with a recess which receives a pivoted mouthpiece connected to the upper end of the liquid outlet tube: the recess has a pivoted cover for closing the recess and enclosing the mouthpiece. Preferably the cover is coupled to the mouthpiece so that as the cover is pivoted to its open position, he mouthpiece is pivoted upwards to a ready-to-use position. The cover may be arranged to seal with the lid when closed across the recess of the lid.

Instead of being connected through the lid at their upper ends, either or both of the liquid outlet and air intake tubes may be connected through the wall of the body part of the drinking vessel, adjacent its upper end. In any event, the tube or tubes may be straight or spiral in form: if both the liquid outlet and air intake tubes are spiral in form, they preferably follow spiral paths of opposite hands.

Either or both the liquid outlet and air intake tubes may extend downwardly on the exterior of the body part, for at least part of their paths, then enter the interior space of the body part of the vessel through its wall. The body part may be formed with a double side wall, in which case either or both of the liquid outlet and air intake tubes may be disposed, for at least part of their paths, within the hollow space of the side wail: this space may itself form a passage either for the outlet of liquid or the intake of air, or may be partitioned to form passages both for the outlet of liquid and the intake of air.

Embodiments of the present invention will now be described by way of examples only and with reference to the accompanying drawings, in which.

Figure 2:
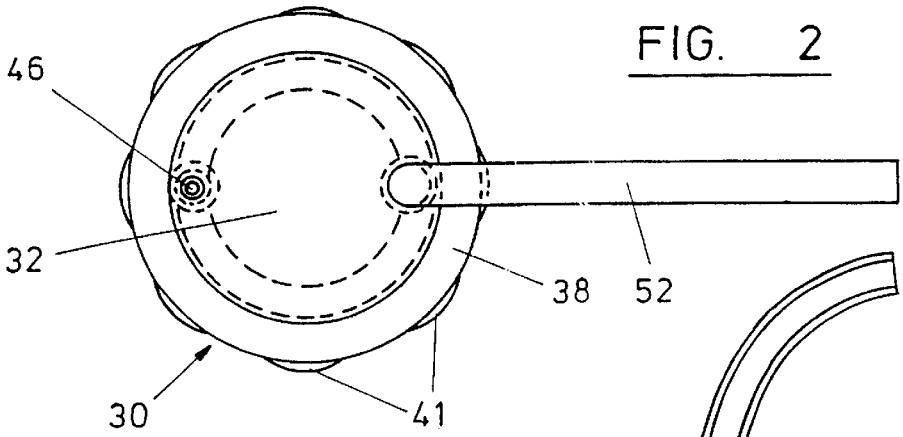
FIG. 2 is a top view of the vessel shown in FIG. 1.
Figure 1:
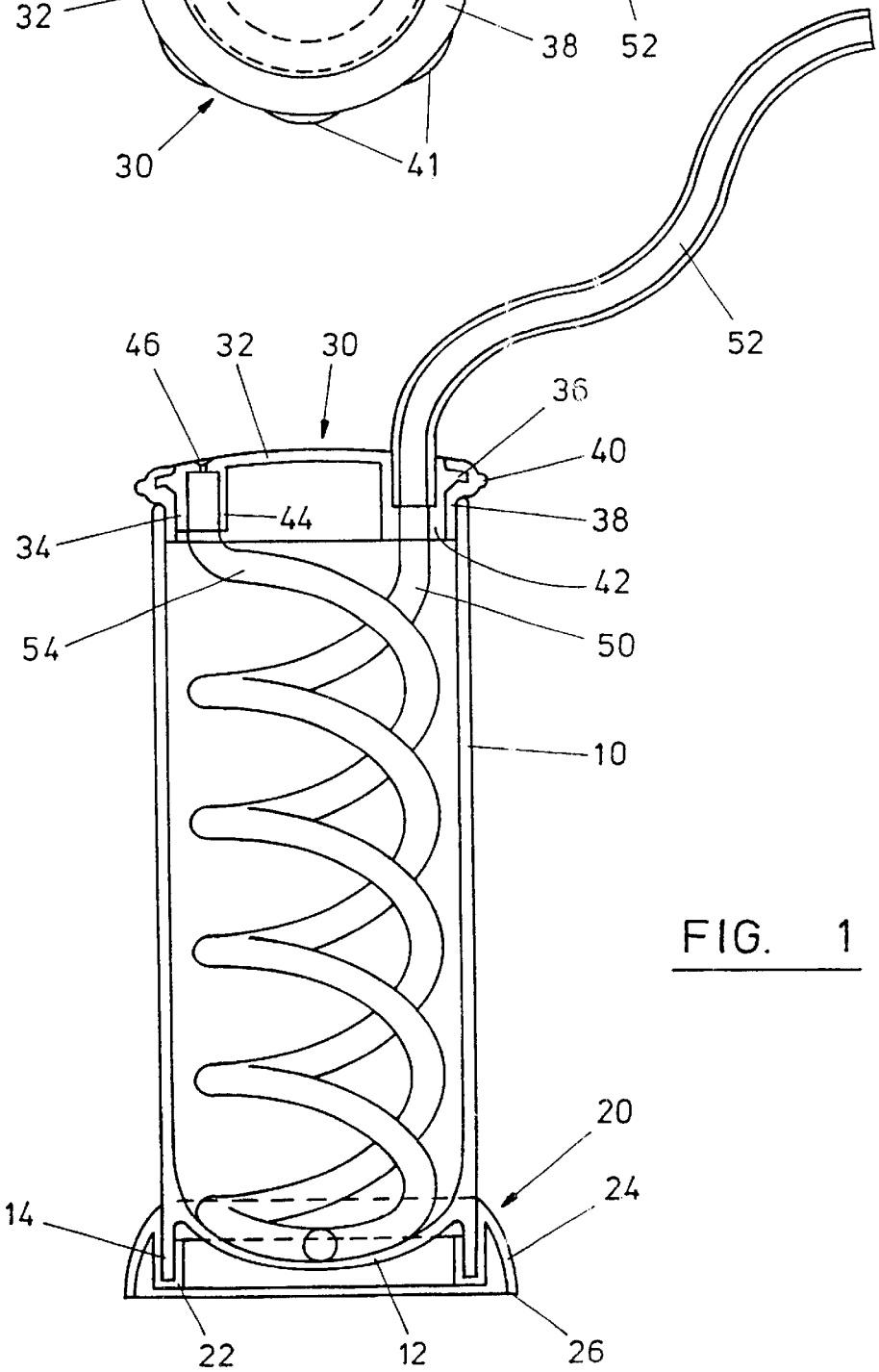
FIG. 1 is a sectional view of a first embodiment of drinking flask or vessel in accordance with the present invention.

Referring to FIGS. 1 and 2 of the drawings, there is shown a drinking flask or vessel which comprises a cylindrical body part 10 fitted at its bottom with a base part 20 and closed at its upper end by a removable lid 30. The cylindrical body part 10 is closed at its bottom end by an outwardly-domed wall 12 and has a projecting rim 14 which forms an extension of the main side wall of the body part. The base part 20 is generally ring-shaped and comprises a U-shaped section 22 on its radially-inner periphery to define an annular groove which receives the rim 14 of the body part 10. From the upper edge of the outer periphery of the U-shaped section 22, an outer peripheral wall 24 extends downwardly and outwardly in a curve, to terminate in a bottom edge 26 by which the flask may rest on a flat surface. The base part 20 is a push-fit onto the rim 14 and is held in place by adhesive.

The lid 30 comprises a main part 32 which has a depending skirt 34 and a radially-outwardly projecting rib 36. The lid further comprises a peripheral seal 38 of elastomeric material, which has been moulded onto the main part 32 and covers the outer side of the skirt 34 and the rib 36: the seal 38 includes a radially-cutwardly projecting flange 40 in register with the rib 36 of the main part of the lid and having spaced enlargements 41 (FIG. 2). It will be noted that the lid fits into the top end of the body part 10 of the vessel with the seal 38 partially compressed between the inner surface of the body part 10 of the vessel and the skirt 34 of the main part 32 of the lid, and the flange 40 of the seal seated on the top edge of the body part 10 of the vessel.

The main part 32 of the lid is also formed on its underside, and at diametrically opposite positions, with enlargements 42,44 in wall thickness of the skirt 34. Enlargement 42 is formed with a through-bore the lower end of which receives one end of a liquid outlet tube 50 and the upper end of which receives one end of a suction tube 52.

Enlargement 44 is formed with a socket which extends from the underside of the lid almost to the top, where a small orifice 46 is formed to provide an air, inlet. An air intake tube 54 has one end fitted into the socket in enlargement 44. The liquid output and air intake tubes 50,54 are secured in their respective sockets by adhesive: the suction tube 52 may be similarly secured in position or it may be removable.

It will be noted that each of the liquid outlet and air intake tubes 50,54 follow spiral paths (of opposite hands) right to the bottom of the vessel.

The body part 10 of the vessel, and preferably also the main part 32 of the lid, are formed of transparent plastics material, e.g. polycarbonate. The base part 20 may be of a coloured plastics material. The liquid outlet, suction and air intake tubes 50,52,54 may be of transparent, translucent or opaque plastics material. At least the suction tube, and preferably all three tubes, are flexible.

In use, the user sucks on the suction tube 52 to draw liquid, from within the vessel, through the liquid outlet tube 50 and the suction tube 52 and into his mouth. In order to replace the volume of liquid which is drawn out of the vessel, air flows in through the orifice 46 and through the air intake tube 54, to emerge from the latter tube right at the bottom of the vessel: this air then bubbles upwards through the liquid within the flask.

Thus, as the user proceeds to drink from the vessel, air bubbles upwardly through the liquid. This may enhance the liquid itself, but in any event-provides an attractive feature for the user to observe through the transparent walls of the vessel and also to feel the vibratory effect of the bubbles passing through the liquid.

Figure 4:
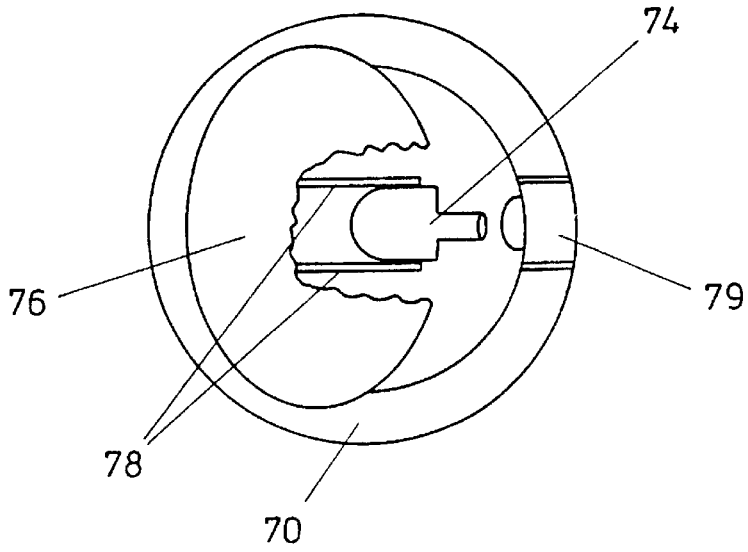
FIG. 4 is a top view of the vessel shown in FIG. 3.
Figure 3:
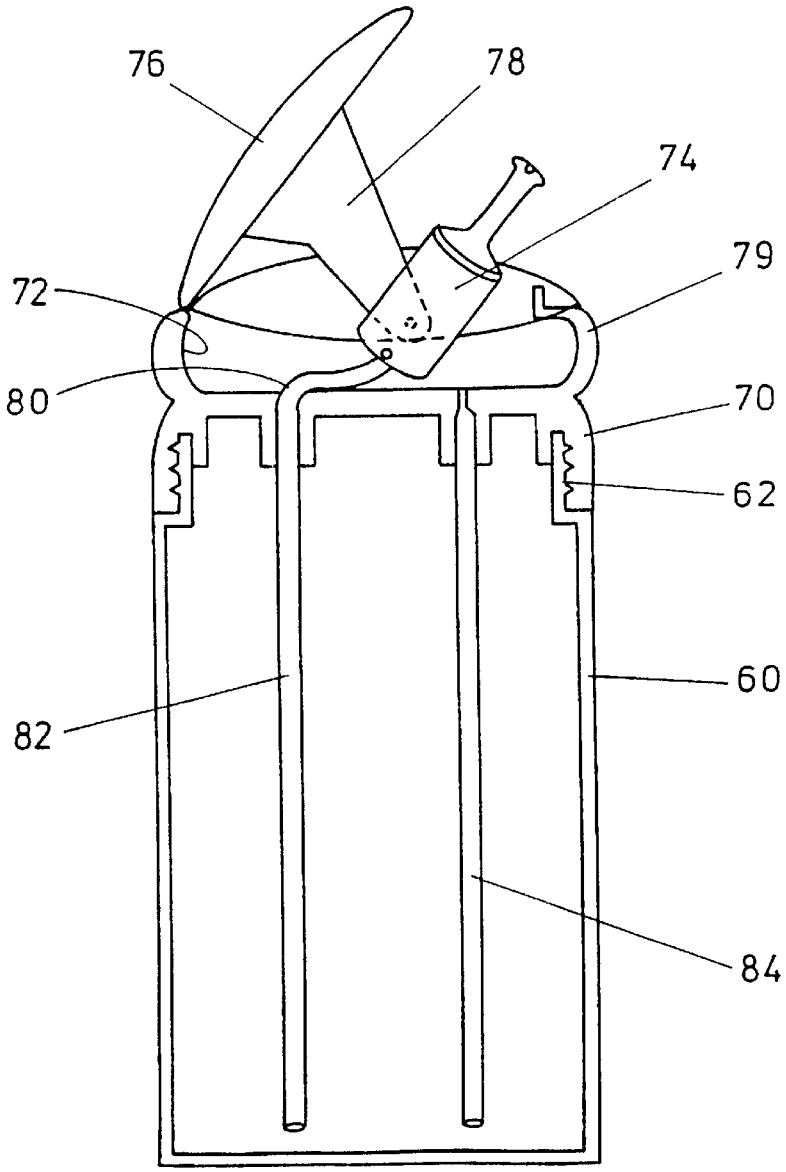
FIG. 3 is a sectional view of a second embodiment of drinking vessel in accordance with the present invention.

FIGS. 3 and 4 show a second embodiment of flask or drinking vessel in accordance with the present invention. This vessel comprises a transparent, cup-shaped body part 60 the upper end of which is closed by a removable lid 70. The underside of the lid 70 is formed with a peripheral groove which fits in sealed manner over the peripheral rim 62 of the base part 60. The upperside of the lid 70 is formed with a recess 72 in which a mouthpiece 74 is pivotally mounted. The lid further comprises a hinged cover or flip-top 76 for the recess 72, the cover 76 being coupled to the mouthpiece 74 by a bifurcated link 78. For storage or transit, the cover 76 is pivoted downwardly to close the recess 72 and the mouthpiece 74 is received within the recess 72 and enclosed by the cover 76. A latch 79 retains the cover in its closed position: the cover 76 may be arranged to seal against the lid. In use of the vessel, the latch 79 is released and the cover 76 pivoted to its open position: in so doing, the mouthpiece is pivoted upward, by the link 78, to reach the upwardly-inclined position shown in FIG. 3.

The mouthpiece 74 has a longitudinal passage and its lower end is coupled by a flexible tube 80 to the upper end of a liquid outlet tube 82 which extends from the underside of the lid substantially to the bottom of the vessel. An air intake tube 84 also extends from the underside of the lid substantially to the bottom of the vessel: the lid is formed with a restricted passage to allow air into the vessel.

It will be appreciated that the vessel of FIGS. 3 and 4 has the same advantageous features as the vessel of FIGS. 1 and 2. Thus, as the user applies suction to the mouthpiece 74, liquid is drawn from the vessel via the liquid outlet tube 82 and the mouthpiece: replacement air enters the vessel through the air intake tube 84 and bubbles upwardly through the liquid; the user is able to both observe and feel this bubbling action.

Although the vessel of FIGS. 3 and 4 is shown with liquid outlet and air intake tubes which are straight, they may instead be of the same spiral form as the corresponding tubes shown in FIGS. 1 and 2. Similarly, the liquid outlet and air intake tubes of the vessel of FIGS. 1 and 2 may be straight instead of spiral.

In the examples shown in the drawings, the liquid outlet and air intake tubes extend downwardly from the lid and are disposed within the interior of the body part of the drinking vessel. Instead, either or both of the liquid outlet and air intake tubes may extend downwardly from an upper region of the body part itself, and not be connected to the lid: either or both tubes may extend downwardly within the interior space of the body part of the vessel, or instead either or both tubes may extend downwardly on the exterior of the body part and then enter the interior through the wall of the body part. The body part of the vessel may be formed with a double or hollow side wall, in which case either or both of the liquid outlet and air intake tubes nay be disposed within the hollow space of the side wall: indeed, this space may itself form a passage either for the outlet of liquid or the intake of air (or be partitioned to form passages both for the outlet of liquid and the intake of air).

What is claimed is:

1. A drinking vessel, comprising:

a) a body part having an open top and a bottom remote from said open top, said body part having an interior space providing a vessel for receiving a liquid for drinking;

b) a lid sealed and fitted to said body part for closing said open top in a sealed manner;

c) a liquid outlet passage extending downwardly and opening into said interior space only adjacent said bottom of said body part; and, d) an air intake passage extending downwardly and opening into said interior space only adjacent said bottom of said body part so that, as a user applies suction through said liquid outlet passage for drawing liquid from adjacent said bottom of said body part and thereby creating a partial vacuum within said drinking vessel owing to an air-tight seal created by said sealing of said lid onto said body part, replacement air enters said bottom of said body part through said air intake passage and then bubbles upwardly through the liquid within said drinking vessel.

2. A drinking vessel as claimed in claim 1, in which said body part comprises a side wall, at least part of which is transparent.

3. A drinking vessel as claimed in claim 1, in which at least part of the lid is transparent.

4. A drinking vessel as claimed in claim 1, in which the lid comprises a main part which has a peripheral sealing member of elastomeric material.

5. A drinking vessel as claimed in claim 1, in which a peripheral sealing member of elastomeric material is provided on the rim of said body part in order to seal with said lid.

6. A drinking vessel as claimed in claim 1, in which the liquid outlet and air intake passages comprise respective tubes which are connected to the lid and extend downwardly within the interior space of the body part of the vessel.

7. A drinking vessel as claimed in claim 6, in which the liquid outlet and air intake tubes are engaged with the lid at generally diametrically opposite positions of the latter.

8. A drinking vessel as claimed in claim 6, in which the air intake tube is coupled to a duct extending through the lid, of small cross-sectional size relative to the air intake tube.

9. A drinking vessel as claimed in claim 1, in which the upperside of the lid is formed with a recess which receives a pivoted mouthpiece connected to the liquid outlet passage.

10. A drinking vessel as claimed in claim 9, comprising a pivoted cover for closing said recess and enclosing said mouthpiece.

11. A drinking vessel as claimed in claim 10, in which said cover is coupled to the mouthpiece so that as the cover is pivoted to its open position, the mouthpiece is pivoted upwards to a ready-to-use position.

12. A drinking vessel as claimed in claim 1, in which the liquid outlet and/or air intake passage comprises a tube which is connected through the wall of the body part, adjacent the open top of the body part.

13. A drinking vessel as claimed in claim 1, in which the liquid outlet and/or air intake passage comprises a tube which is spiral in form.

14. A drinking vessel as claimed in claim 1, in which the liquid outlet and air intake passages comprise tubes which follow spiral paths of opposite hands.

15. A drinking vessel as claimed in claim 1, in which the liquid outlet passage and/or the air intake passage comprises a tube which extends downwardly on the exterior of the body part, for at least part of its path, and then enters the interior space of the body part through its wall.

16. A drinking vessel as claimed in claim 1, in which the body part is formed with a double side wall, the liquid outlet and/or air intake passages being formed within the hollow space of the side wall.

* * * * *